United States Patent [19]

Bullock, III

[11] Patent Number: 4,815,620

[45] Date of Patent: Mar. 28, 1989

[54] TAMPER-EVIDENT CAP HAVING PLURAL DIAMETERS

[75] Inventor: Joseph J. Bullock, III, Atherton, Calif.

[73] Assignee: Cap Snap, Inc., San Jose, Calif.

[21] Appl. No.: 101,261

[22] Filed: Sep. 25, 1987

[51] Int. Cl.[4] ..... B65D 41/48

[52] U.S. Cl. ..... 215/256

[58] Field of Search ..... 215/256, 254, 252, 253

[56] References Cited

U.S. PATENT DOCUMENTS

| | | | |
|---|---|---|---|
| 3,434,613 | 3/1969 | Langecker | 215/256 |
| 3,940,004 | 2/1976 | Faulstich | 215/256 |
| 4,166,552 | 9/1979 | Faulstich | 215/256 |
| 4,305,517 | 12/1981 | Dennis | 215/256 |
| 4,307,821 | 12/1981 | McIntosh | 215/256 X |
| 4,561,553 | 12/1985 | Crisci | 215/256 |
| 4,593,830 | 6/1986 | Bullock | 215/256 |
| 4,667,839 | 5/1987 | Crisci | 215/256 |
| 4,676,389 | 6/1987 | Bullock | 215/256 X |
| 4,699,287 | 10/1987 | Bullock | 215/256 |
| 4,700,860 | 10/1987 | Li | 215/256 |

FOREIGN PATENT DOCUMENTS

| | | | |
|---|---|---|---|
| 954475 | 9/1974 | Canada | 215/256 |
| 1137029 | 12/1982 | Canada | 215/256 |
| 1393366 | 10/1965 | France | 215/256 |

*Primary Examiner*—Stephen Marcus

*Assistant Examiner*—Nova Stucker

*Attorney, Agent, or Firm*—Julian Caplan

[57] ABSTRACT

A plastic cap for a container neck formed with upper and lower external locking beads has a top disk from which depends an upper outer skirt having an upper internal locking bead and a larger diameter lower skirt having a lower internal locking bead. Between the skirt sections is an outward extending flange which is weakened by a notch cut in its outer corner to form a circumferential line of weakness. When the cap is seated on the neck the upper and lower beads inter-engage, the cap cannot be removed without evidence of tampering. To fracture the flange at the line of weakness, in one form of the invention, a tear tab depends from the lower edge of the skirt and a curved score line at the upper end of the tear tab extends up from the lower edge of the skirt to the level of the line of weakness. Pulling the tab tears the skirt at the curved score line and around the line of weakness, removing all or a sufficient portion of the lower skirt and its lower internal locking bead. In another form of the invention, a tear tab connected to the lower skirt extends upward, displaced outward of the lower skirt and the latter is weakened in a substantially vertical score line extending up from the lower edge of the skirt to the line of weakness. By bending the tab outward the score line is broken and by pulling the tab around the cap, the lower skirt is torn off.

11 Claims, 2 Drawing Sheets

TAMPER-EVIDENT CAP HAVING PLURAL DIAMETERS

FIELD OF THE INVENTION

This invention relates to a new and improved tamper-evident cap having a top disk from which depend upper and lower outer skirts having upper and lower locking beads respectively which lock under cooperating external beads on the bottle neck with which the cap is used. The lower skirt is of larger diameter than the upper and the juncture between the two comprises a flange which is notched away to create a circumferential line of weakness. The flange may be broken away at the line of weakness to remove the lower skirt and its lower locking bead thereby making it possible to remove the cap from the neck.

DESCRIPTION OF RELATED ART

The neck shown in the accompanying drawings is a commercially available neck with which the cap of the present invention fits. The cap and neck are generally of the type shown in U.S. Pat. No. 4,667,839 upon which the present invention is an improvement.

SUMMARY OF THE INVENTION

The cap of the present invention is shaped to engage with a thin-walled blow molded plastic cap of the type used for milk and bottled water having a neck formed with an inward turned flange at its upper end and having upper and lower external locking beads, the lower locking bead being radially offset outward relative to the upper bead. The cap has a top disk from which depend outer and inner skirts, the space between the skirts being equal to the width of the top flange of the neck. The outer skirt slants downward outward and has an internal locking bead positioned to seat under the external locking bead of the skirt. Below the top internal locking bead is a flange and below the flange is a lower skirt portion of a diameter greater than that of the upper skirt portion. The bottom edge of the lower skirt portion seats on the shoulder of the bottle neck. On the lower skirt portion is an internal locking bead which seats under the lower external locking bead of the neck. The flange of the cap is cut away so that there is a line of weakness between the upper and the lower skirt portions.

In one form of the invention there is a tear tab depending from the lower end of the skirt adjacent a curved score line. By pulling upward on the tear tab and along the curved score line and along the line of weakness, the lower skirt and its lower locking bead may be torn away. Thereafter the upper skirt portion may be pried off the cap without undue effort, whereas when the lower skirt is intact it is virtually impossible to pry the cap off the neck. In a modification, the tear tab extends upward from the bottom edge of the skirt and there is a gap between the tear tab and the lower skirt as well as a larger gap between the tear tab and the upper skirt. One edge of the tear tab is joined to the lower skirt in a thin line which may be fractured when the tear tab is bent outward. The vertical line extends up to the aforesaid line of weakness of the flange between the upper and lower skirt sections. Hence, by bending the tear tab outward, the tab fractures along the vertical score line and by pulling the tab circumferentially around the cap, the lower cap may be torn away along the line of weakness.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 1:
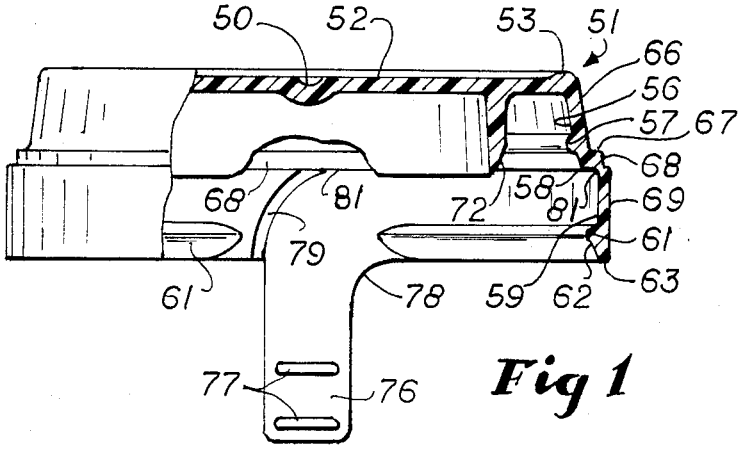
FIG. 1 is a side elevational view of one form of cap in accordance with the present invention, partially broken away to reveal internal construction.
Figure 9:
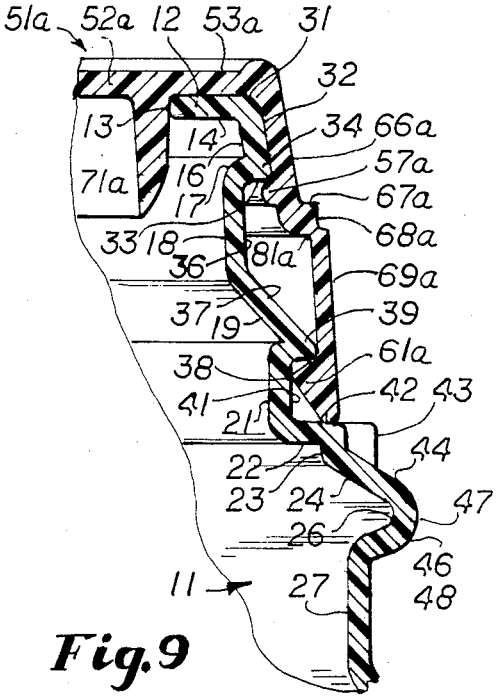
FIG. 9 is an enlarged sectional view taken substantially along the line 9—9 of FIG. 7 and showing the cap seated on a container neck.
Figure 8:
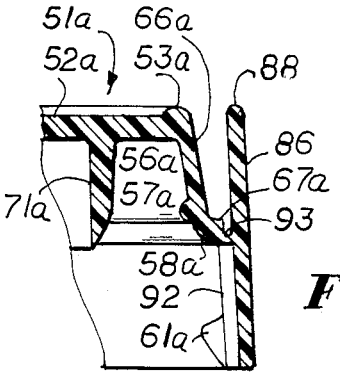
FIG. 8 is an enlarged sectional view taken substantially along the line 8—8 of FIG. 7.
Figure 7:
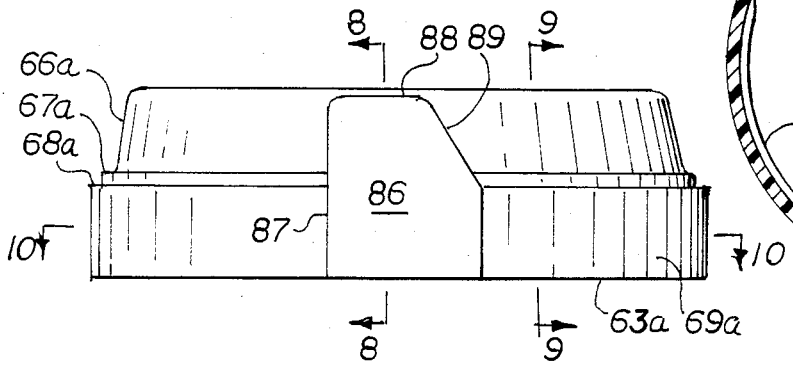
FIG. 7 is a fragmentary side elevational view of a modified cap.
Figure 10:
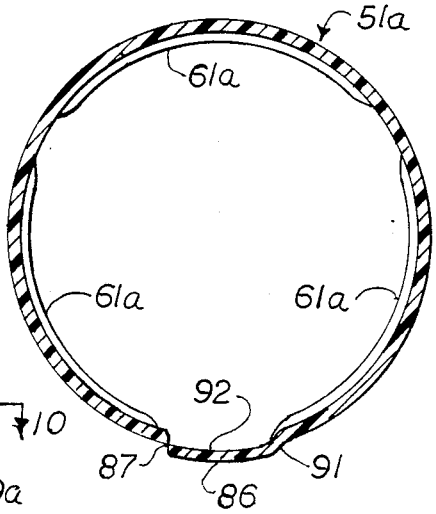
FIG. 10 is a sectional view taken substantially along the line 10—10 of FIG. 7.

The container neck 11 shown in FIGS. 2-4 and 9 is presently commercially available and is illustrated herein to show how the cap 51 hereinafter described in detail seats thereon. Neck 11 has a top lip or flange 12 disposed substantially horizontally inward, the lip 12 having an inner edge 13. Describing now the interior of the neck, the underside 14 of flange 12 extends radially outward and joins a downward stretch 16 which is disposed at about 10 degrees from the vertical. There is a curved corner 17 on the lower end of the stretch 16 and this merges into a substantially vertical stretch 18 which in turn merges with a downward-outward stretch 19. Spaced inward of the lower end of the stretch 19 is a second vertical stretch 21 which merges into a second horizontal stretch 22. At the inner end of stretch 22 is a very short vertical stretch 23 which gives way to a downward-outward stretch 24, the latter terminating in a groove 26 below which is a vertical stretch 27. The shape of the neck below stretch 27 is not of significance in an understanding of the present invention.

Directing attention now to the exterior of the neck 11, the upper surface of lip 12 terminates in a corner 31 and below the corner 31 is a downward-outward inclined stretch 32 disposed at an angle of about 10 degrees to the vertical. At the lower end of stretch 32 is a substantially horizontal first shoulder 33, the surfaces 32 and 33 defining an upper external locking bead 34. Below shoulder 33 is a substantially vertical stretch 34 which is parallel to stretch 18 and this terminates at its lower end in an outward-downward stretch 37 disposed at an angle of about 45 degrees to the horizontal. At the lower end of stretch 37 is a second substantially horizontal shoulder 38 which gives way to a second vertical stretch 41 parallel to stretch 21. At the lower end of stretch 41 is a horizontal shoulder 42, the outer edge of which is serrated in interrupted beads 43. Below shoulder 42 is a downward inclined stretch 44 terminating in a rounded surface 46 and below the surface 46 is an inward offset vertical stretch 48. The surfaces 44, 46 and 48 define a bumper ring 47 which is gripped by fingers in filling and loading the container as is well understood in the art.

Figure 2:
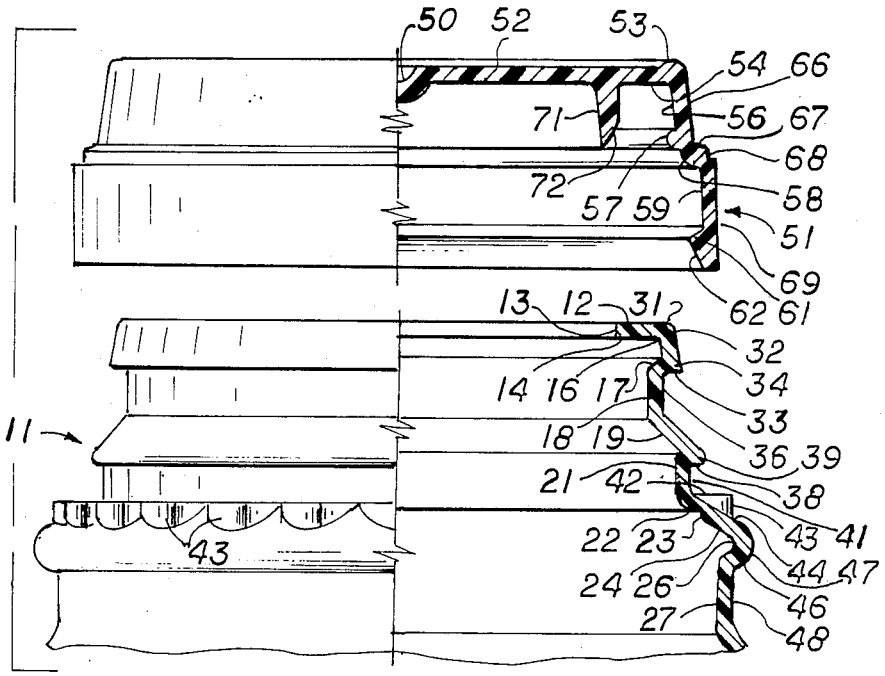
FIG. 2 is an exploded side elevational view of a cap and the container neck structure onto which the cap fits, both the cap and the neck being broken away to reveal internal construction.
Figure 3:
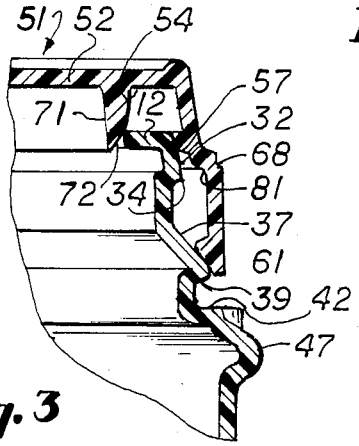
FIG. 3 is a fragmentary vertical sectional view showing one step in the seating of the cap on the neck.
Figure 4:
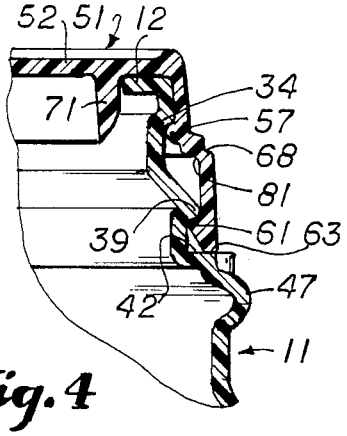
FIG. 4 is the fragmentary sectional view showing the cap fully seated on the neck.
Figure 6:
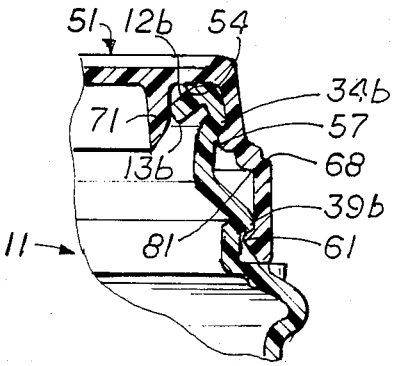
FIG. 6 is a view similar to FIG. 4 of a modified neck flange structure.

The neck **11*b* shown in FIG. 6 is substantially identical to that of FIGS. 2–4 except that the lip 12*b* is longer than the lip 12 and hence in the assembled position of cap 51 and neck 11*b* is bent downward-inward so that the inner edge 13*b* seals against the inner skirt or plug 71** in a more effective manner.

Directing attention now to the cap shown in FIGS. 1–6, there is a top disk 51 having a central indentation or dimple 50 and having a raised outer rim 53. The depressed portion inside the rim 53 is a suitable location for a label as conventionally used in the milk and bottled water industries. The underside 54 of disk 52 is dimensioned so that the upper surface of lip 12 seals thereagainst as best shown in FIG. 4.

Cap 51 has an outer skirt which comprises an outward inclined stretch 66 disposed at an angle of about ten degrees to the vertical and on the lower end thereof is an upper internal locking bead 57 here shown as semicircular in cross section and continuous around the inside of the surface 56. However, it will be understood that the bead 57 may assume other cross sectional shapes and may be interrupted rather than continuous. Below bead 57 is a curved surface 58 of an arc of about 90 degrees. Below curved surface 58 is a substantially vertical stretch 59 and on the lower end thereof is a lower internal locking bead 61. Again, the shape of the bead 61 is subject to some variation. As shown, the upper surface of bead 61 slants downward at an angle of approximately 30 degrees and then below the inner terminus of bead 61 slants downward-outward at an angle of 55 degrees to the horizontal. The bead 61 is preferably thicker than the bead 57 so that when the lower portion of the skirt is intact the bead 61 securely engages the neck 11. However the proportions of the beads 57 and 61 are subject to variation. Furthermore, as shown herein, the bead 61 is interrupted in that it has three separate sections. However, it will be understood that the number of such sections and the shapes of the bead are subject to variation. Below bead 61 is the bottom edge 63 of cap 51.

Directing attention now to the exterior of the outer skirt of cap 51, beyond rim 53 there is a downward inclined surface 66 disposed with an angle of about ten degrees to the vertical and parallel to the surface 56. At the lower end of surface 66 is a shoulder or flange 67 which is downwardly-outwardly inclined at an angle of about ten degrees to the horizontal. There is a notch 68 in the outer corner of shoulder 67, the purpose of which is to form a line of weakness 81 extending circumferentially around the cap. When the lower skirt is torn away, as hereinafter explained, the cap skirt fractures at line 81. Below flange 67 is a substantially vertical stretch 69 continuing down to the bottom edge 63.

In a preferred form of the invention, there is an inner skirt or plug 17 spaced inward of surface 56 and having a thin curved outer lower corner 72.

Depending from the lower edge 63 is a tear tab 76 here shown as rectangular and having a pair of gripping ridges 77 on its inside surface so that the user may grasp the tab 76 when it is desired to open the container. The upper edge of tab 76 on one side curves as shown by reference numeral 78 merging into lower edge 63. The upper edge of tab 76 extends vertically upward to the lower edge 63 and beyond lower edge 63 the interior of the lower skirt portion is formed with a curved score line 79 which merges with the line of weakness 81.

Directing attention now to FIG. 3, it will be seen that the interior of the cap 51 assists in properly centralizing the cap relative to the neck 11. The inner end 13 of lip 12 engages the curved surface 72 of inner plug 71. The curved upper internal bead 57 rests on the slanted surface 32 and the underside of the lower internal bead 61 rests on the surface 37. Downward pressure applied to the disk 52 causes the cap 51 to seat on the neck 51. The cap is stretched to enable the bead 57 to lock under the bead 34 and the bead 61 to lock under the bead 39. The slanted surfaces 32 and 37 act as ramps and the curved surfaces of the beads 51 and 61 slide down the ramp. The lower edge 63 fits flush against the shoulder 42 in the seated position shown in FIG. 4. Interrupted beads 43 of shoulder 42 make it difficult for a dishonest patron to insert a fingernail or implement under the edge 63 and pry the cap off until the skirt has been torn away. In the position shown in FIG. 4 it is virtually impossible to remove the cap 51 from the neck 11 without either crushing the neck 11 or so damaging the cap 51 that tampering is evident.

Figure 5:
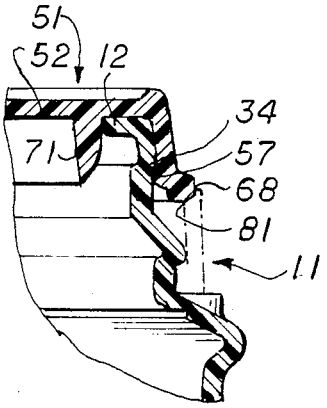
FIG. 5 is a sectional view showing the lower skirt broken away to provide a reclosure cap for the neck.

In order to open the container, the user grips the tear tab 76 and tears upwardly along the curved score line 79 and then horizontally around the cap for a distance around the cap so as to tear away the lower skirt at the lin e of weakness 81 with the result that the bead 61 is disengaged at the shoulder 39. When the lower skirt is thus torn as shown in FIG. 5, the consumer may use his fingers or fingernails to pry under the curved surface 58 which extends away from the neck and pull the preclosure cap upward so that the bead 57 disengages from the bead 34. As is illustrated, the fact that the surfaces 36 and 37 are spaced inward from surfaces 58 and 59 affords ample room for the fingers or fingernails to grip under the surface 58. When only part of the contents of the container are dispensed, the reclosure cap may be reseated on the neck as many times as desired.

Directing attention now to the form of the invention shown in FIGS. 7–10, many of the elements of the cap **51*a* are the same as that of cap 51 and the same reference numerals followed by the subscript a are used to designate corresponding elements. Tear tab 86 extends up from the lower edge 63*a* of the cap to a level slightly below the rim 53*a*. The upper edge 88 of tab 86 is displaced outwardly from the surface 66*a* so that the fingers may be inserted in the gap therebetween in order to pull the tab 86 upward. As viewed in FIGS. 7 and 10, the left hand edge 87 of tab 86 is a thin connection to the surface 69*a* so that when the tab 86 is pulled outwardly, it breaks away from the remainder of the outer skirt along the line 87. On the other hand, the lower right hand edge 91 is curved inward toward the surface 69*a*. The upper corner 89 of tab 87 is truncated so that the user will naturally grip the tab 86 and pull it in the proper direction (i.e. counterclockwise) as viewed in FIG. 10. As best shown in the lower portion of FIG. 8, the tab 86 is positioned with an offset 92 relative to the remainder of the lower skirt section. There is a line of weakness 93 between the tab 86 and the curved surface 58*a* (see FIG. 8**).

In use, seating of the cap of FIGS. 7–10 is accomplished in substantially the same manner as the preceding modification. However, when it is desired to open the container, by pulling the tab 86 away from the cap the line of weakness 93 breaks and then the line of weakness 87 breaks. Pulling the tab 86 in a counterclockwise direction causes the lower portion of the skirt and the lower bead 61*a* to be torn away along the line of weakness 81*a*. The portion above flange 67*a* functions as a reclosure cap. The user may pry under the surface 58*a* to pull the closure cap off. The reclosure cap may be repeatedly reseated on the container neck as desired.

What is claimed is:

1. A cap for closing a container of the type having a neck having upper and lower external locking bead means, said lower external locking bead means being spaced outward relative to said upper external locking bead means, said cap comprising a top disk, an upper skirt portion depending from said top disk formed with upper internal locking bead means shaped and positioned to engage the upper external locking bead means of said neck when said cap is seated on said neck, an outward extending flange on the lower edge of said upper skirt portion, a lower skirt portion depending from the outer edge of said flange, and having a diameter larger than said upper skirt portion and of said flange and formed with lower internal locking bead means shaped and positioned to engage the lower external locking bead means of said neck, said flange being formed with a circumferential notch at its upper outer corner, the bottom of said notch having an intersection with the top of said lower skirt portion comprising a first circle, said lower skirt portion having an inner wall which intersects the underside of said outward extending flange in a second circle, said first circle being larger than and having an elevation higher than said second circle, the section of said cap between said circles comprising a downward-inward slanted zone of weakness, a tear tab fixed to said lower skirt portion, said lower skirt portion being formed with a weakened area adjacent said tab and communicating with said zone of weakness of said flange, whereby when a user grips and pulls said tear tab, said lower skirt is torn at said weakened area and said zone of weakness is torn, thereby removing a substantial portion of said lower internal locking bead means from engagement with said lower external locking bead means to permit removal of said cap from said neck.

2. A cap according to claim 1 which further comprises a central plug depending from said disk spaced inward from said upper skirt.

3. A cap according to claim 1 in which said upper skirt portion is downward-outward slanted.

4. A cap according to claim 1 in which said lower internal locking bead means comprises a lower bead having a substantially greater cross-sectional area than said upper bead.

5. A cap according to claim 1 in which said tear tab projects upward from said lower skirt portion and said weakened area comprises a thin line alongside said tear tab from the bottom edge of said lower skirt portion to said zone of weakness.

6. A cap according to claim 5 in which said tear tab is opffset radially outwardly relative to said lower skirt portion.

7. In combination, a container neck and a cap for closing said neck, said neck comprising an upper annular upward-inward directed first flange, an outward-downward slanted first stretch terminating in an inward extending first shoulder, said first stretch and said first shoulder defining upper external locking bead means, a downward extending second stretch indented relative to said first stretch, an outward-downward slanted third stretch terminating in an inward extending second shoulder, said third stretch and said second shoulder defining lower external locking bead means, a downward extending fourth stretch indented relative to said third stretch, said second shoulder being offset outward relative to said first shoulder, said cap comprising a top disk, an upper skirt portion depending from said top disk formed with upper internal locking bead means shaped and positioned to engage said upper external locking bead means when said cap is seated on said neck, an outward extending second flange on the lower edge of said upper skirt portion, a lower skirt portion depending from said second flange, and having a diameter larger than said upper skirt portion and formed with lower internal locking bead means shaped and positioned to engage said lower external locking bead means, said second flange being formed with a circumferential notch at its upper outer corner, the bottom of said notch having an intersection with the top of said lower skirt portion comprising a first circle, said lower skirt portion having an inner wall which intersects the underside of said outward extending second flange in a second circle, said outward extending second flange intersecting the extension of said lower skirt portion in a second circle, said first circle being larger than and having an elevation higher than said second circle, the section of said cap between said circles comprising a downward-inward slanted zone of weakness, a tear tab fixed to said lower skirt portion, said lower skirt portion being formed with a weakened area adjacent said tab and communicating with said zone of weakness of said second flange, whereby when a user grips and pulls said tear tab, said lower skirt is torn at said weakened area and said zone of weakness is torn, thereby removing a substantial portion of said lower internal locking bead means from engagement with said lower external locking bead means to permit removal of said cap from said neck.

8. A combination according to claim 7 which further comprises a central plug depending from said disk spaced inward from said upper skirt, said upper annular first flange engaging the underside of said top disk and nesting between said plug and said first stretch of said neck and sealing against said plug.

9. A combination according to claim 7 in which said second flange extends away from said second stretch so that, after said lower skirt portion is torn away, the user may grip said second flange to pull said cap off said neck.

10. A combination according to claim 7 in which said tear tab projects upward from said lower skirt portion and said weakened area comprises a thin line alongside said tear tab from the bottom edge of said lower skirt portion to said zone of weakness.

11. A combination according to claim 10 in which said tear tab is offset radially outwardly relative to said lower skirt portion.

* * * * *

REEXAMINATION CERTIFICATE (1279th)

United States Patent [19]

Bullock, III

[11] B1 4,815,620

[45] Certificate Issued May 8, 1990

[54] TAMPER-EVIDENT CAP HAVING PLURAL DIAMETERS

[75] Inventor: Joseph J. Bullock, III, Atherton, Calif.

[73] Assignee: Cap Snap Co., San Jose, Calif.

Reexamination Request:
No. 90/001,800, Jun. 23, 1989

Reexamination Certificate for:

| | |
|---|---|
| Patent No.: | **4,815,620** |
| Issued: | **Mar. 28, 1989** |
| Appl. No.: | **101,261** |
| Filed: | **Sep. 25, 1987** |

[51] Int. Cl.[5] ..... B65D 41/48
[52] U.S. Cl. ..... 215/256
[58] Field of Search ..... 215/256

[56] References Cited

U.S. PATENT DOCUMENTS

| | | | |
|---|---|---|---|
| 2,162,711 | 6/1939 | Hamberger | 215/252 |
| 2,162,712 | 6/1939 | Hamberger | 215/252 |
| 3,329,295 | 7/1967 | Fields | 215/252 |
| 3,434,613 | 3/1969 | Langecker | 215/256 |
| 3,812,994 | 5/1974 | Feldman | 215/256 |
| 3,913,771 | 10/1975 | Acton et al. | 215/256 |
| 3,940,004 | 2/1976 | Faulstich | 215/256 |
| 4,166,552 | 9/1979 | Faulstich | 215/256 |
| 4,202,455 | 5/1980 | Faulstich | 215/31 |
| 4,305,517 | 12/1981 | Dennis | 215/256 |
| 4,307,821 | 12/1981 | McIntosh | 215/256 X |
| 4,496,066 | 1/1985 | Bullock, III | 215/320 |
| 4,522,307 | 6/1985 | Steiner | 215/219 |
| 4,561,553 | 12/1985 | Crisci | 215/256 |
| 4,589,561 | 5/1986 | Crisci | 215/256 |
| 4,593,830 | 6/1986 | Bullock | 215/256 |
| 4,658,977 | 4/1987 | Crisci | 215/256 |
| 4,667,839 | 5/1987 | Crisci | 215/256 |
| 4,676,389 | 6/1987 | Bullock | 215/256 X |
| 4,687,114 | 1/1986 | Crisci | 215/256 |
| 4,699,287 | 10/1987 | Bullock | 215/256 |
| 4,700,860 | 10/1987 | Li | 215/256 |
| 4,837,818 | 6/1983 | Conti | 215/256 |
| 4,844,268 | 7/1989 | Bullock, III | 215/256 |

FOREIGN PATENT DOCUMENTS

| | | | |
|---|---|---|---|
| 0954475 | 9/1974 | Canada | 215/256 |
| 1137029 | 12/1982 | Canada | 215/256 |
| 2442341 | 3/1987 | Fed. Rep. of Germany | |
| 1393366 | 10/1965 | France | 215/256 |

*Primary Examiner*—Stephen Marcus

[57] ABSTRACT

A plastic cap for a container neck formed with upper and lower external locking beads has a top disk from which depends an upper outer skirt having an upper internal locking bead and a larger diameter lower skirt having a lower internal locking bead. Between the skirt sections is an outward extending flange which is weakened by a notch cut in its outer corner to form a circumferential line of weakness. When the cap is seated on the neck the upper and lower beads inter-engage, the cap cannot be removed without evidence of tampering. To fracture the flange at the line of weakness, in one form of the invention, a tear tab depends from the lower edge of the skirt and a curved score line at the upper end of the tear tab extends up from the lower edge of the skirt to the level of the line of weakness. Pulling the tab tears the skirt at the curved score line and around the line of weakness, removing all or a sufficient portion of the lower skirt and its lower internal locking bead. In another form of the invention, a tear tab connected to the lower skirt extends upward, displaced outward of the lower skirt and the latter is weakened in a substantially vertical score line extending up from the lower edge of the skirt to the line of weakness. By bending the tab outward the score line is broken and by pulling the tab around the cap, the lower skirt is torn off.

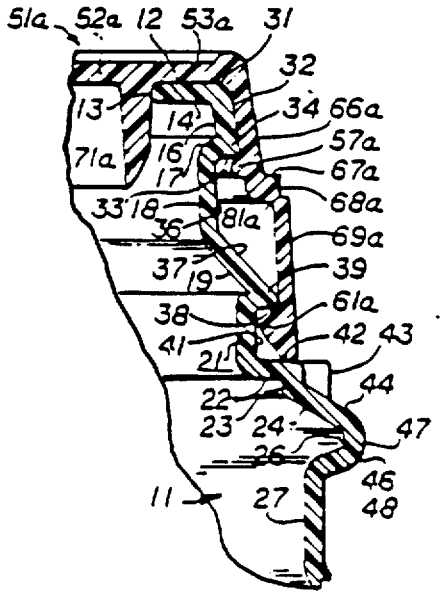

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–11 is confirmed.

* * * * *